US005405027A

United States Patent [19]

Plass

[11] Patent Number: 5,405,027

[45] Date of Patent: Apr. 11, 1995

[54] LIMIT SWITCH WEIGHT APPARATUS FOR CRANE HOIST DRIVES

[75] Inventor: Thomas E. Plass, New Berlin, Wis.

[73] Assignee: Harnischfeger Corporation, Brookfield, Wis.

[21] Appl. No.: 182,438

[22] Filed: Jan. 14, 1994

[51] Int. Cl.[6] ..... B66C 23/90

[52] U.S. Cl. ..... 212/152; 254/269

[58] Field of Search ..... 212/132, 152, 159; 254/270, 269

[56] References Cited

U.S. PATENT DOCUMENTS

| | | | |
|---|---|---|---|
| 761,884 | 6/1904 | Harding | 212/132 |
| 2,365,141 | 12/1944 | Sally | 254/269 |
| 3,233,746 | 2/1966 | Fawell | 212/132 |
| 3,834,551 | 9/1974 | Nanowsky | 212/152 |
| 4,300,134 | 11/1981 | Paciorek | 212/152 |
| 4,560,074 | 12/1985 | Manning | 212/152 |
| 4,905,849 | 3/1990 | Coull | 254/269 |

OTHER PUBLICATIONS

Harnischfeger Bulletin ED-8-Limit Switches-Types DB135, DB270 and DB540.

Harnischfeger Bulletin 592-Type HB Control Circuit Limit Switch for Hoist Motion.

Harnischfeger Bulletin 592-DB90 Power Limit Switch for Hoist Motion.

Harnischfeger Bulletin 592-Limit Switches for Hoist Motion.

*Primary Examiner*—Michael S. Huppert
*Assistant Examiner*—Thomas J. Brahan
*Attorney, Agent, or Firm*—Jansson & Shupe, Ltd.

[57] ABSTRACT

Disclosed is a crane hoist system having a hoist drum, a drum drive motor and control and power circuit limit switches. The improvement involves a first trip bar coupled to the power circuit limit switch and a second trip bar coupled to the control circuit limit switch. The bars are-vertically aligned and both are pivot mounted at their corresponding ends. The second trip bar is mounted for movement independently of the first trip bar. If the control circuit limit switch fails to function as the second bar is moved a suitable distance upward, such bar contacts and lifts the first bar which, in turn, trips the power limit switch. In one embodiment, both bars are straight and elongate and in another, the second bar is "U" shaped.

12 Claims, 8 Drawing Sheets

FIG. 7
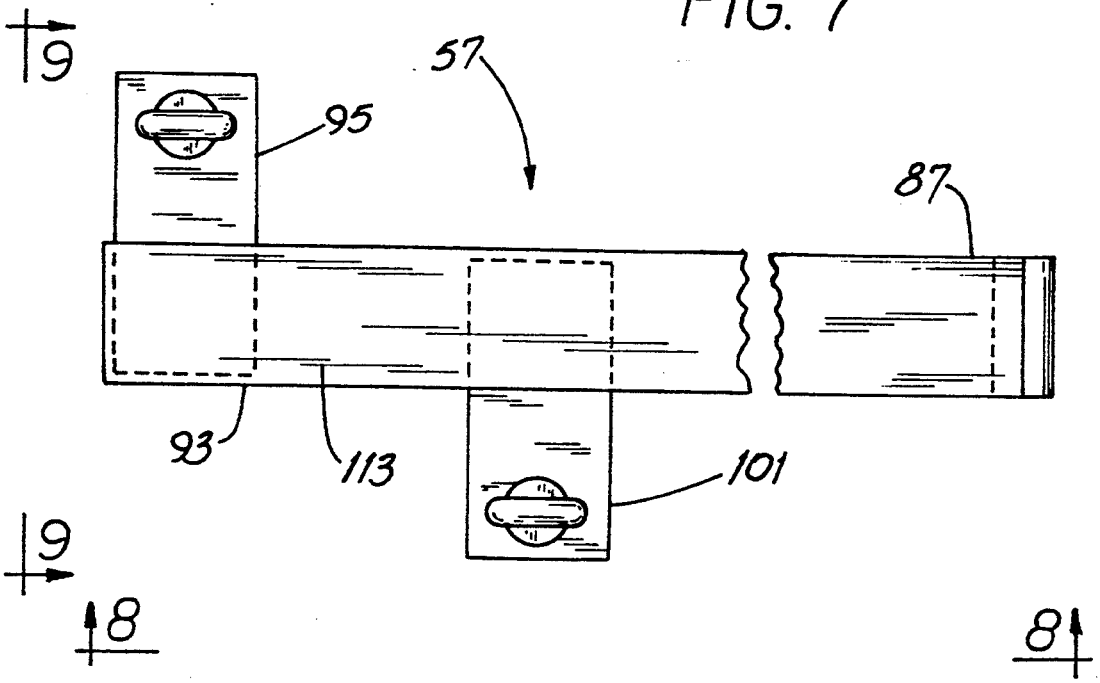
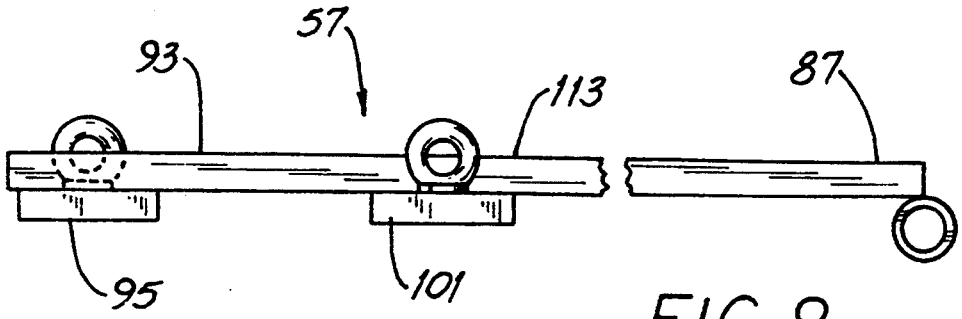
FIG. 8
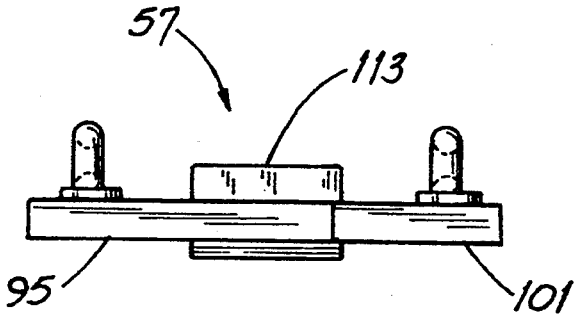
FIG. 9

LIMIT SWITCH WEIGHT APPARATUS FOR CRANE HOIST DRIVES

FIELD OF THE INVENTION

This invention is related generally to material handling machines and, more particularly, to overhead load-hoisting cranes.

BACKGROUND OF THE INVENTION

Material handling machines are available in a wide variety of configurations to suit particular applications. Such machines include fork-type lift trucks, front end loaders and many others.

Another type of material handling machine (and the one to which the invention relates), is known as an overhead travelling crane. In a common configuration, such cranes include a pair of bridge girders spanning rather widely spaced railroad type bridge rails. Such rails are suspended above, for example, a factory floor or an outdoor steel handling yard. The girders are supported and propelled by flanged wheels riding atop the rails.

Mounted atop each girder and extending along its length is a trolley rail, atop which is mounted a trolley capable of "traversing" movement, i.e., movement along a line generally normal to the line of movement of the entire crane. The trolley is equipped with at least one hoist drive and a load-hoisting hook (or other load-handling device) suspended from a bottom block for moving loads from place to place. So configured, the crane is capable of lifting a load from any location on a factory floor, for example, and moving it to any other location.

A factor considered by designers of overhead travelling cranes is the possibility of the bottom block being raised to an elevation at which it strikes the solid undercarriage of the trolley. In that event, there is a substantial risk of breaking the stranded rope-like steel cables by which the bottom block is attached to the rotating hoist drum. If a cable breaks, there is a chance that the load will be uncontrollably dropped.

To help guard against that eventuality, crane designers have employed a control circuit limit switch and a power circuit limit switch actuated in one of the ways described below. If the bottom block reaches a certain elevation, the control limit switch is tripped. Such limit switch tripping disables the control circuit or, in the alternative, "reconfigures" the control circuit in such a way that the hoist drive controller causes the rate of bottom block ascent to slow markedly. If the operator fails to stop the hoist drive or if the control limit switch malfunctions for some reason, the bottom block continues its upward movement and trips the power limit switch which opens the power connections to the hoist drive motor and stops bottom block movement before such block strikes the trolley undercarriage.

A typical known arrangement includes a control limit switch coupled to the rotating hoist drum shaft or to the shaft of an intermediate gear reduction installed between the hoist motor and the hoist drum. The power circuit limit switch has a heavy block-shaped weight suspended from one end of a counterweighted arm. The torque produced by the weight is greater than that produced by the counterweight and the weight retains the power switch in the operative position.

On the other hand, when the weight is lifted by the ascending bottom block, the counterweight "takes over" and trips the power switch. Viewed another way, the control circuit limit switch is actuated by rotary shaft motion and the power limit switch is actuated by the upward linear motion of the bottom block.

In another somewhat less common arrangement involving two hoists (and two bottom blocks) on a single hoist drive, the control circuit limit switch is also equipped with a suspended weight. Such switch is tripped when one of the bottom blocks lifts the weight; the power circuit limit switch is tripped when the other bottom block lifts that limit switch weight.

While these arrangements have been generally satisfactory for their intended purpose, they are attended by certain disadvantages. For example, if it is desired to use both a power limit switch and a control limit switch of the weighted type, it has been necessary to use two bottom blocks, one for each switch.

Yet another disadvantage is that the block-like weight suspended from a limit switch represents a relatively small "target" to be contacted and lifted by the bottom block. Notwithstanding precautionary measures, e.g., a bail-like structure looped around the dead ends of the hoisting cable to act as a guide, there have been instances where the bottom block fails to contact the limit switch weight. Broken hoist cable can result.

A limit switch weight apparatus useful in cranes and overcoming the aforementioned disadvantages would be an important advance in the art.

OBJECTS OF THE INVENTION

It is an object of this invention to provide an improved limit switch weight apparatus overcoming some of the problems and shortcomings of devices of the prior art.

Another object of this invention is to provide an improved limit switch weight apparatus adapted for use with overhead hoist drives.

Another object of this invention is to provide an improved limit switch weight apparatus whereby two limit switches may be actuated by a single hoist bottom block.

Still another object of this invention is to provide an improved limit switch weight apparatus whereby a single hoist bottom block actuates two limit switches in sequence. How these and other important objects are accomplished will become apparent from the following descriptions and from the drawing.

SUMMARY OF THE INVENTION

The invention relates to a crane hoist system having a hoist drum, a drum drive motor, a motor control circuit limit switch and a motor power circuit limit switch. Systems having the foregoing components are widely used in a type of material handling machine known as an overhead travelling crane.

Briefly stated, the improved limit switch weight apparatus of the invention involves two trip bars, each mounted at one end for pivoting motion. The second trip bar (which is coupled to the control circuit limit switch) is urged upward by the crane bottom block being hoisted by the rotating drum. If, for some reason, the control circuit limit switch fails to slow or disable the drive motor, the second bar continues to rise and contacts and lifts the first trip bar. This actuates the power circuit limit switch and disables the hoist drive motor as described more fully below.

A feature of the invention is that the second trip bar is mounted on a pivot joint at or near its first end for movement independently of the first trip bar. In one specific arrangement, the pivot joint of the second bar is attached to the first bar.

And the first bar also pivots. It has a first end attached to a swivel mount and the second bar pivot joint is attached to the first bar adjacent to the swivel mount. Since both bars pivot at corresponding ends, the action of the bars can be considered as being somewhat scissors-like.

In yet other aspects of the invention, the load hoisting system has what is known as a bottom block. Such block has pulley-like sheaves over which the hoist cables run and also has a hook or other load-lifting device attached to its lower portion. The bottom block is suspended from the hoist drum and moves between a lower elevation and an intermediate elevation.

It is highly preferred that the second trip bar be able to contact and lift the first bar even though the bars may be somewhat out of vertical alignment. Accordingly, the second trip bar has a large-area surface (rather than a knife-like edge) which is substantially in contact with the first trip bar when the bottom block is at the intermediate elevation. In one specific arrangement, the trip bars have differing cross-sectional shapes in that the first or upper bar is circular in cross-section and the second bar is, for example, rectangular with a large-area surface facing upward toward the first bar.

And the invention has yet other features which increase the opportunity for the second bar to rise and contact, rather than miss, the first bar. The second trip bar has a longitudinal axis and two lugs, i.e., a support lug and a control lug, extending laterally away from the axis. Such lugs extend in differing directions, e.g., 180° from one another and normal to the bar long axis, and are spaced along the second bar.

In a specific arrangement, the support lug is adjacent to the second end of the second bar, i.e., to that end opposite the pivot end. On the other hand, the control lug is "stagger mounted," i.e., spaced from the second end.

A support member such as a chain extends between the support lug and a stationary point on the crane. The chain supports the weight of the second bar during most periods of operation. Similarly, a flexible trip cable extends between the control lug and the control circuit limit switch.

Thus, there is a space between the chain and the cable and the first trip bar is "captured" in that space and prevented from significant lateral movement. When so arranged, the upper or first trip bar is maintained generally vertically aligned with the lower trip bar.

In another exemplary arrangement, the second trip bar is curvilinear rather than straight and has a second end which pivots on a second pivot joint adjacent to the second end. In a specific embodiment, the second bar is horseshoe or "U" shaped.

As with the straight second bar, the curved version of such bar has a surface extending between the first end and the second end. Such surface is substantially in contact with the first trip bar when the bottom block is at the intermediate elevation.

In yet another aspect of the invention, the power circuit limit switch has an arm rotatable between a motor-operating position and a motor-disabled position and the hoist drum has a bottom block suspended from it. When the apparatus disables the motor, the bottom block is contacting the second trip bar, the second trip bar is contacting the first trip bar and the power circuit limit switch arm is in the motor-disabled position.

Further details regarding the invention are set forth in the following description and in the drawing.

BRIEF DESCRIPTION OF THE DRAWING

FIG. 7 is a top plan view of the second trip bar shown in FIG. 3. Parts are broken away and certain surfaces are in dashed outline.

FIG. 8 is a side elevation view of the bar shown in FIG. 7 taken along the viewing plane 8—8 thereof. Parts are broken away and certain surfaces are in dashed outline.

FIG. 9 is an end elevation view of the bar shown in FIG. 7 taken along the viewing plane 9—9 thereof. Certain surfaces are in dashed outline.

DETAILED DESCRIPTIONS OF THE PREFERRED EMBODIMENTS

Figure 1:
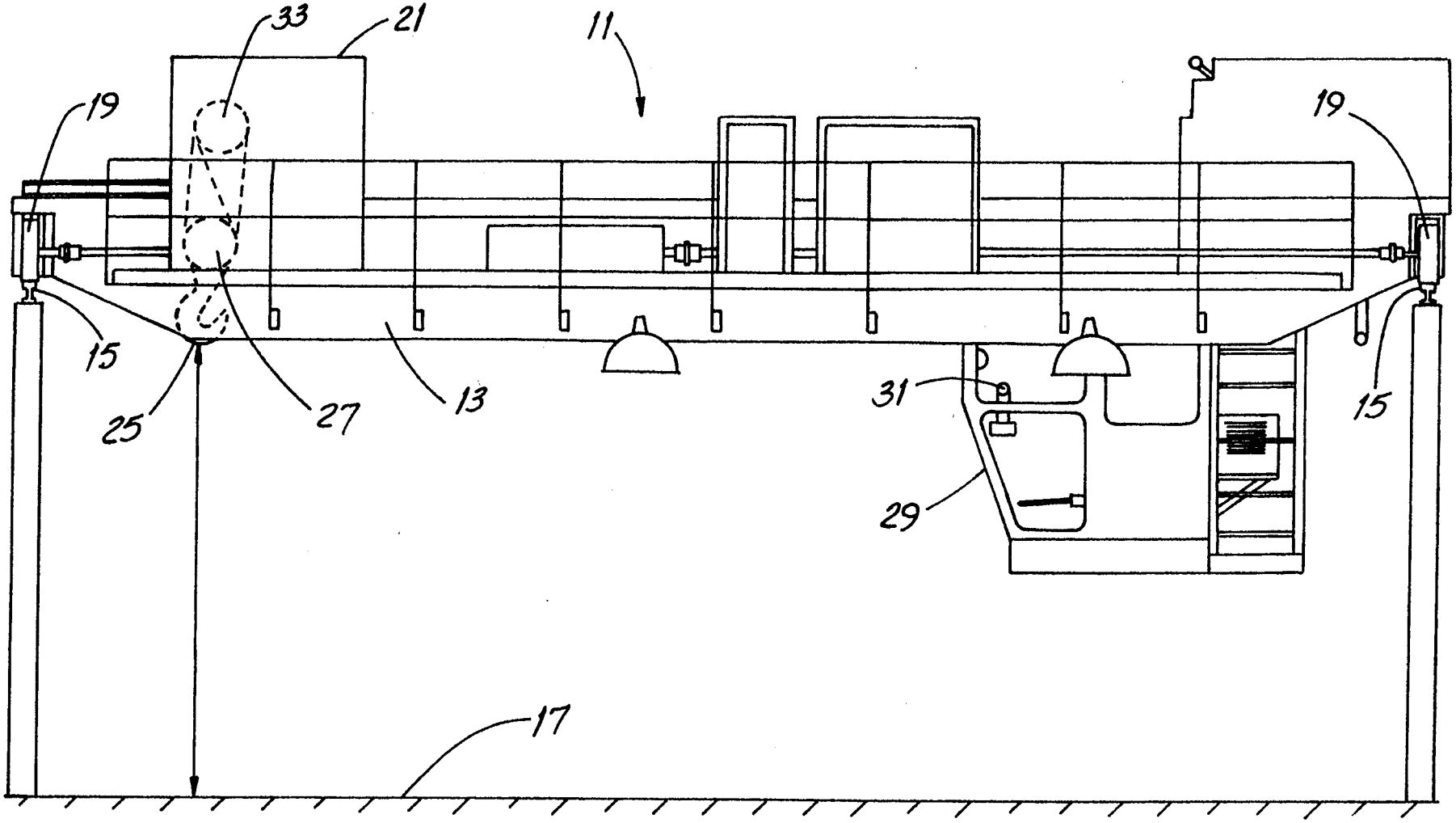
FIG. 1 is a representative side elevation view of an overhead travelling crane shown in conjunction with an exemplary factory floor. Certain surfaces are shown in dashed outline.
Figure 2:
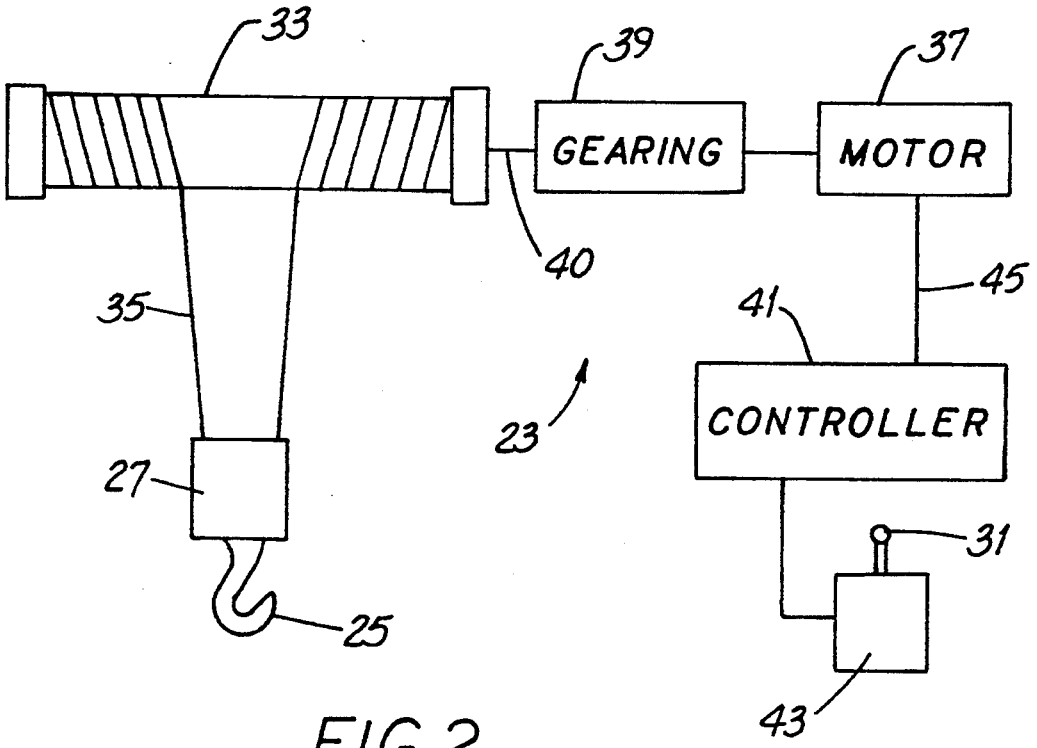
FIG. 2 is a simplified diagram of a hoist drive and a hoist drum for a crane like that shown in FIG. 1.

Before describing details of the inventive apparatus 10, it will be helpful to have an understanding of the general arrangement of an overhead load-hoisting crane and of typical power and control circuit limit switches used on such a crane. Referring to FIGS. 1 and 2, the exemplary overhead travelling crane 11 includes a pair of bridge girders 13 spanning rather widely spaced railroad type bridge rails 15. Such rails 15 are suspended above, for example, a factory floor 17. The crane bridge girders 13 are supported and propelled by flanged wheels 19 riding atop the rails 15. When the bridge drive is operated, the crane 11 moves along the rails 15, i.e., into and out of the drawing sheet as viewed in FIG. 1.

Mounted atop the girders 13 is a trolley 21 capable of "traversing" movement along a line generally normal to the line of movement of the entire crane 11, i.e., left and right as seen in FIG. 1. The trolley 21 is equipped with at least one hoist drive 23 and a load-hoisting hook 25 (or other load-handling device) suspended from a bottom block 27 for moving loads from place to place.

Crane movement (including movement of the hoist, bridge and trolley functions) is under the control of an operator working in the crane cab 29. The operator manipulates master switch handles 31 to control direction and speed of each crane function.

FIG. 2 shows a typical hoist drive 23 including a rotating hoist drum 33 from which a bottom block 27 is suspended by cable 35. The drum 33 is driven by an electric motor 37 coupled to the drum shaft 40 through gearing 39 and the motor 37 is controlled (in both speed and direction of rotation) by an electrical controller panel 41 responsive to the operator's master switch 43.

Figure 4:
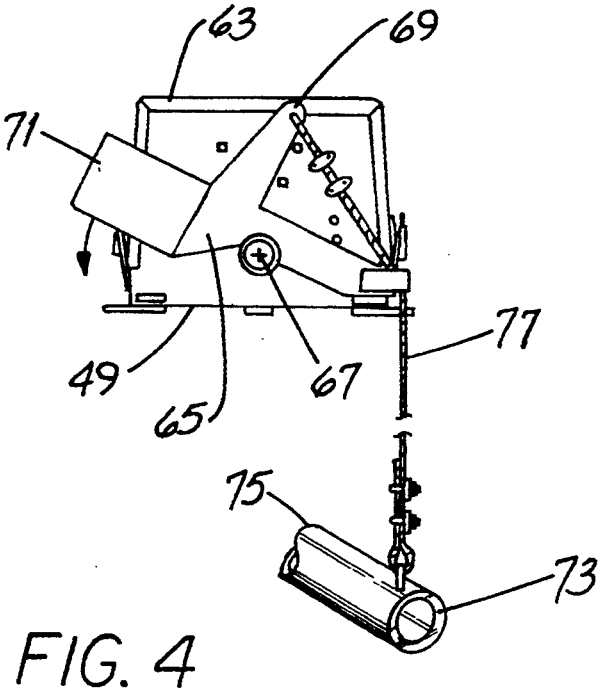
FIG. 4 is a side elevation view of a power circuit limit switch shown in conjunction with another trip bar of the inventive apparatus. The trip bar is in perspective view and parts are broken away.
Figure 3:
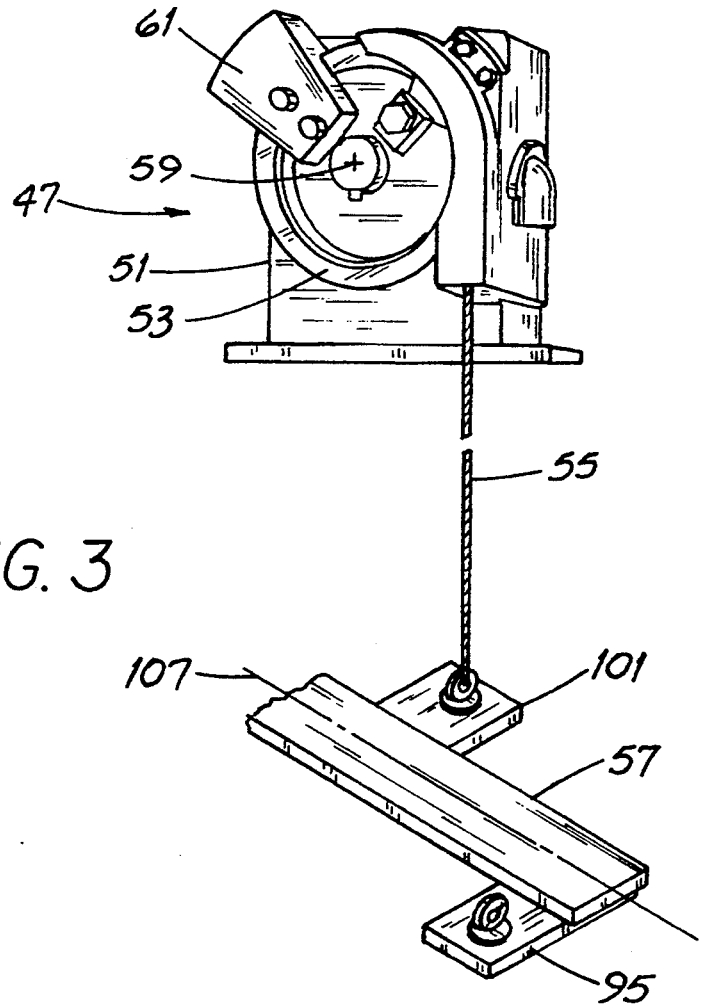
FIG. 3 is a perspective view of a control circuit limit switch shown in conjunction with a trip bar of the inventive apparatus. Parts are broken away.

Referring also to FIGS. 3 and 4, before describing the limit switches 47, 49, it will be helpful to recall that, typically, a control circuit limit switch 47 has its contacts connected to the motor controller 41 and its control circuitry used to open and close contactors, relays and the like. On the other hand, a power circuit limit switch 49 is connected directly in the power leads 45 to the motor 37. Therefore, a power circuit limit switch 49 does not rely upon proper functioning of intervening relays, contactors and the like; such switch 49 disables the motor 37 directly.

FIG. 3 illustrates an exemplary control circuit limit switch 47 having a cabinet 51 containing electrical contacts connected in the motor controller 41. The switch 47 has a pulley-like sheave 53 from which a cable 55 extends to attach to a trip bar 57. The sheave 53 pivots about the axis 59 of the switch shaft and has a counterweight 61.

When the cable 55 supports the weight of the bar 57 (or a substantial portion thereof), the sheave 53 is in the illustrated position. If the bottom block 27 is raised to an elevation at which the bar 57 is lifted, the counterweight 61 causes counterclockwise rotation of the sheave 53. The switch contacts are thereby opened to either prevent (using intervening contactors and the like) the motor 37 from being electrically powered in the hoisting direction or to slow the rotational speed of the motor 37. Whether the switch 47 stops or slows the motor 37 is a function of how the switch contacts are wired into the circuitry of the controller 41 in a known manner.

FIG. 4 illustrates an exemplary power circuit limit switch 49 having a cabinet 63 containing electrical contacts connected in the motor power lead 45. Specifically, the limit switch 49 is connected in the power leads 45 extending from the controller 41 to the motor 37.

The switch 49 is equipped with an arm 65 which pivots about the axis 67 of the switch shaft and which has a cable end 69 and a counterweight 71. The second or outer end 73 of the first trip bar 75 is suspended from the arm 65 by a rope-like steel cable 77 and when the cable 77 supports the weight of the bar 75, the arm 65 is in the illustrated position.

If the bottom block 27 is raised to an elevation at which the bar 75 is lifted, the counterweight 71 causes counterclockwise (as shown in FIG. 4) rotation of the arm 65. The contacts are thereby opened, disconnecting the motor 37 from electrical power.

Figure 6:
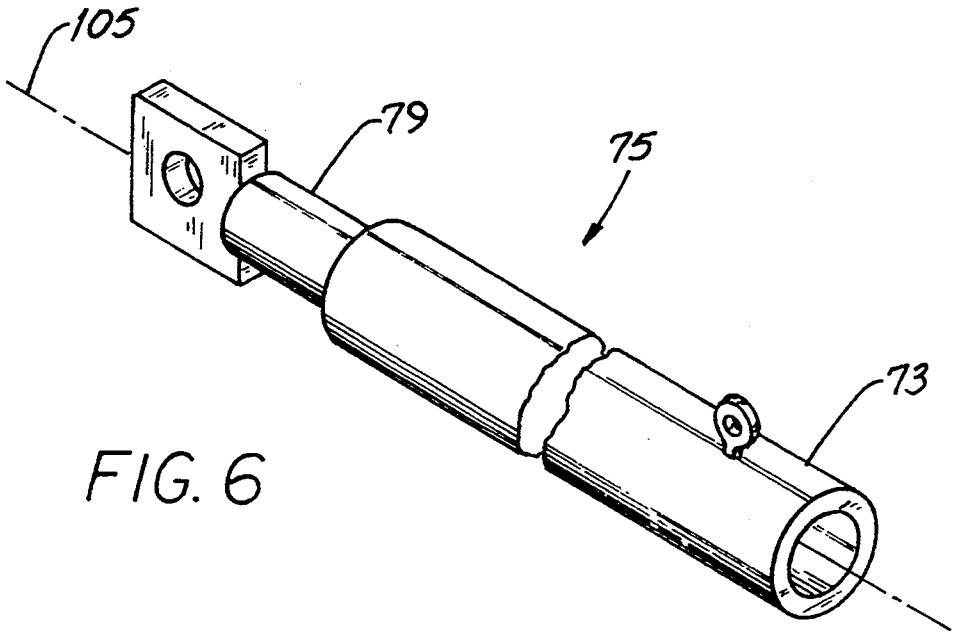
FIG. 6 is a perspective view of the first trip bar shown in FIG. 5. Parts are broken away.
Figure 5:
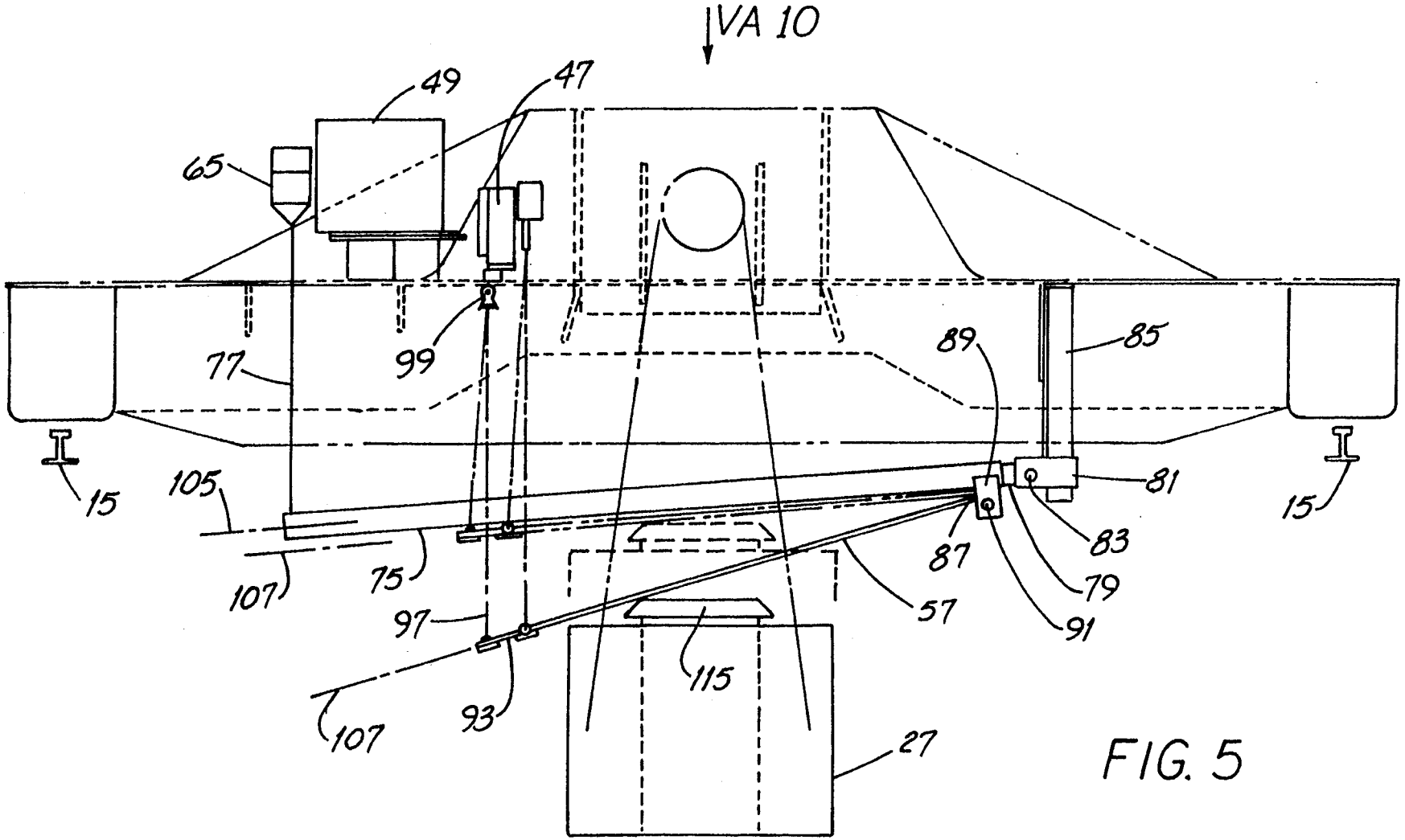
FIG. 5 is a simplified side elevation view of a crane generally like that shown in FIG. 1. Certain surfaces are shown in dashed outline and an alternate position of the bottom block is in dashed outline.

Further details regarding the inventive limit switch weight apparatus 10 will now be provided. Referring now to FIGS. 5 and 6, the power circuit limit switch 49 and the control circuit limit switch 47 are both mounted on and move with the trolley 21. The first trip bar 75 has its first or inward end 79 attached to a swivel mount 81 for pivoting movement about the mount axis 83. The mount 81 is rigidly attached to a support leg 85.

The cable 77 extends downward from the switch arm 65 and is attached at or near the second, outer end 73 of the bar 75. Unless lifted by an external force (as exerted by a rising bottom block 27 as described above and below), the bar 75 retains the switch 49 in the "motor-operating" position shown in FIG. 4.

Referring also to FIGS. 3, 5, 7, 8 and 9, the second trip bar 57 has its first or inward end 87 attached to a pivot joint 89 and such bar 57 pivots about the joint axis 91. In one highly preferred arrangement, the pivot joint 89 is attached to the first trip bar 75 near the inward end 79 of such bar 75 and adjacent to the swivel mount 81. However, the pivot joint 89 may also be mounted on the support leg 85, for example.

At or adjacent to the second or outer end 93 of the bar 57 is a laterally-extending support lug 95 to which is attached one end of a support member embodied as a chain 97 (or cable or the like). The other end of the chain 97 is attached to an anchor 99 that is stationary with respect to the bar 57, e.g., to an anchor 99 on the trolley 21. The primary reason for using the chain 97 in conjunction with the second bar 57 and control circuit limit switch 47 is that unlike the power circuit limit switch 49, the limit switch 47 (being physically much smaller) is much less able to withstand the rigors of supporting the bar 57 during crane operation.

Between the ends 87, 93 and spaced from the outer end 93 there is a laterally-extending control lug 101 to which is attached the end of the limit switch cable 55. The other end of the cable 55 is wrapped on the counterweighted sheave 53 as shown in FIG. 3.

Figure 10:
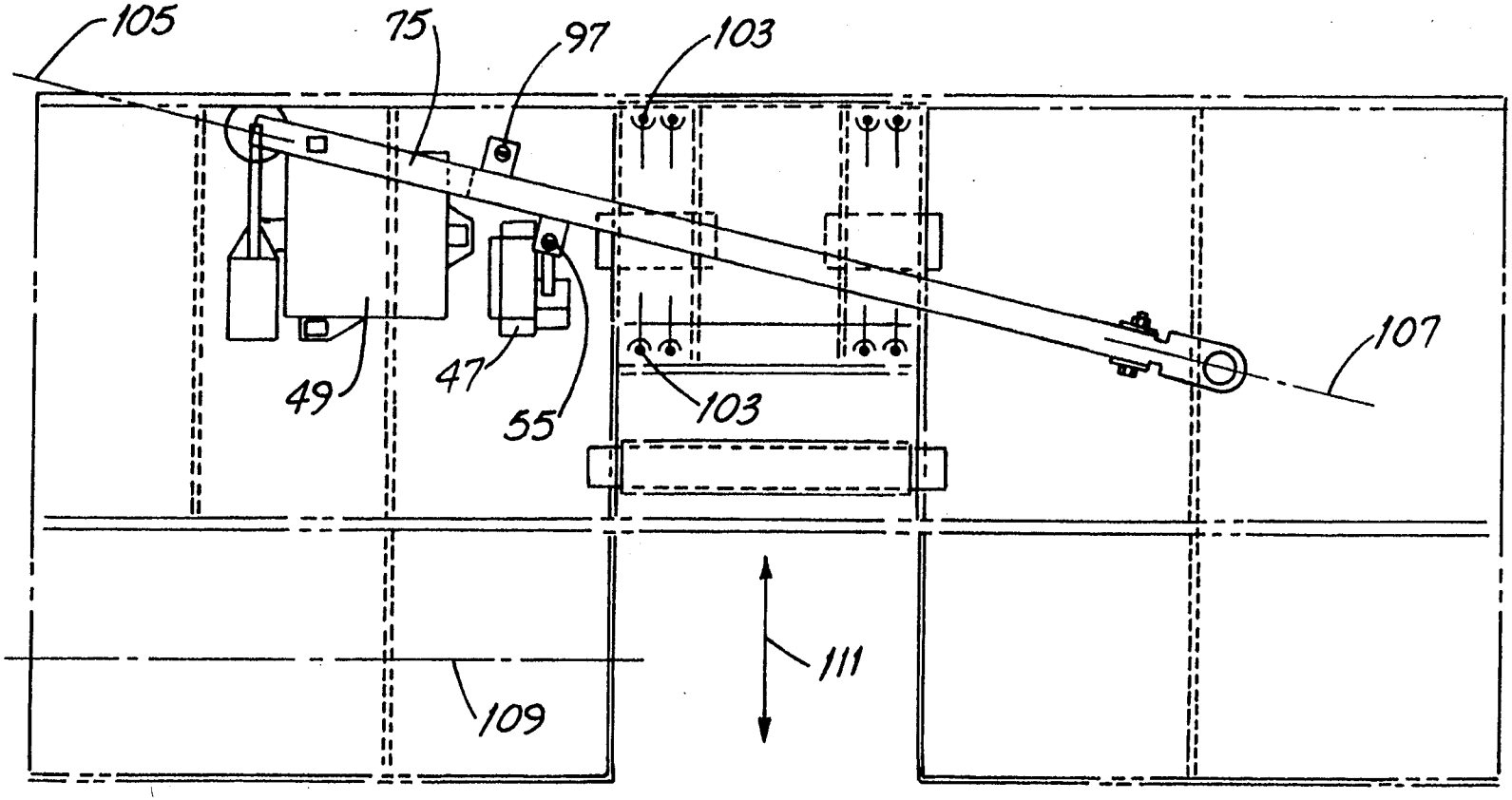
FIG. 10 is a top plan view of the crane shown in FIG. 5 taken generally along the viewing axis VA 10 thereof.

As best seen in FIG. 10, the chain 97 and the cable 55 "straddle" the first trip bar 75 in that such chain 97 and cable 35 extend upward (toward the viewer in FIG. 10) past different respective sides of the bar 75. In that way, the first bar 75 is "captured" and thereby retained in a position substantially directly vertically above the second bar 57. FIG. 10 also shows that both bars extend between the "falls" 103 (as they are called in the industry) of cable 35 extending between the hoist drum 33 and the bottom block 27.

The bars 75 and 57 have longitudinal axes 105 and 107, respectively, and FIG. 10 illustrates that in one preferred arrangement, such axes 105, 107 are angular with respect to either the bridge girder long axis 109 or the line of crane travel 111 along the rails 15. In the specific crane illustrated, angular orientation of the bars 57, 75 prevents such bars 57, 75 and other portions of the hoist mechanism from interfering with one another.

Referring particularly to FIGS. 5–9, in the illustrated arrangement, the first trip bar 75 is tubular or pipe-like and has a circular cross-section. Such shape is selected since tubular products useful to make the bar 75 are widely available in a great variety of diameters and wall thicknesses and are relatively inexpensive.

On the other hand, the second bar 57 is rectangular in cross-section. As a result, it has a large-area surface 113 which helps assure that during operation of the weight apparatus 10 as described below, the second bar contacts 57 and lifts the first bar 75. Of course, persons of ordinary skill in the art will, after appreciating the invention, understand how to make a bar 57 having other cross-sectional shapes to help effect contact of the second bar 57 with the first bar 75.

Figure 11:
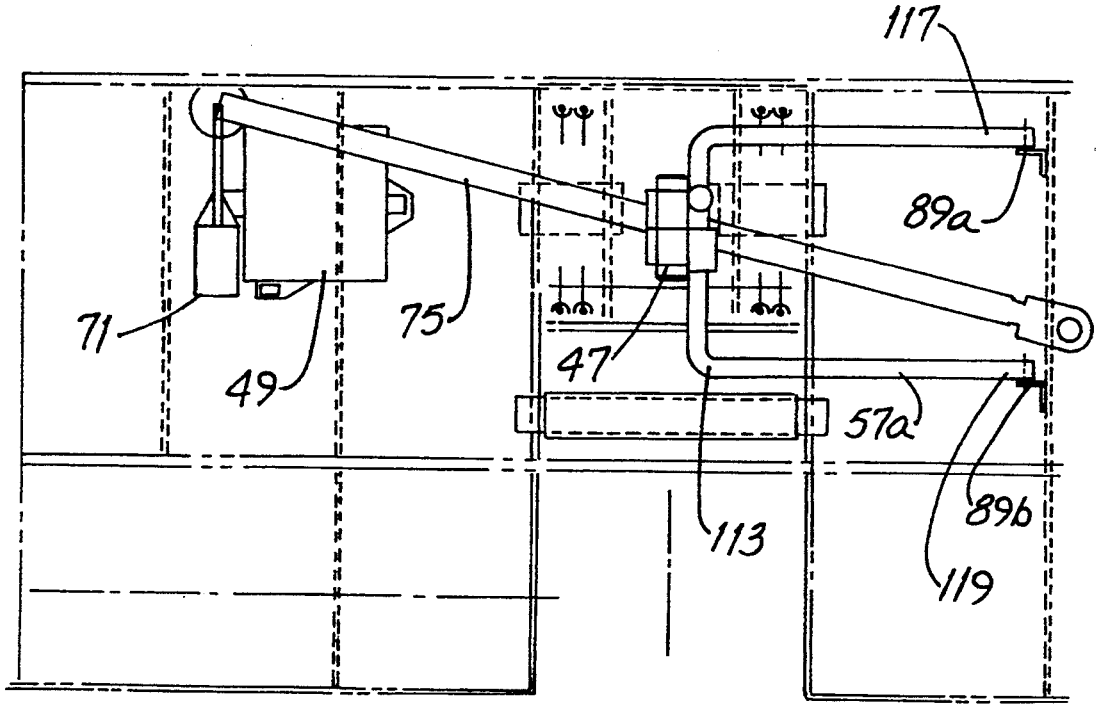
FIG. 11 is a top plan view generally like that of FIG. 10 and showing another embodiment of the inventive apparatus having a "U" shaped second trip bar.

Another exemplary embodiment is shown in FIG. 11 and includes a second bar 57*a* which is curvilinear, e.g., "U" shaped rather than straight. Such second bar 57*a* is supported for pivoting movement by first and second pivot joints 89*a* and 89*b*, respectively. Such joints are at or adjacent to the bar first and second ends 117 and 119, respectively.

Like the bar 57, the bar 57*a* has a surface 113 extending between the ends 117 and 119. Such surface 113 is in contact with the first trip bar 75 when the bottom block 27 is at an intermediate elevation E2 as described below.

Figure 12:
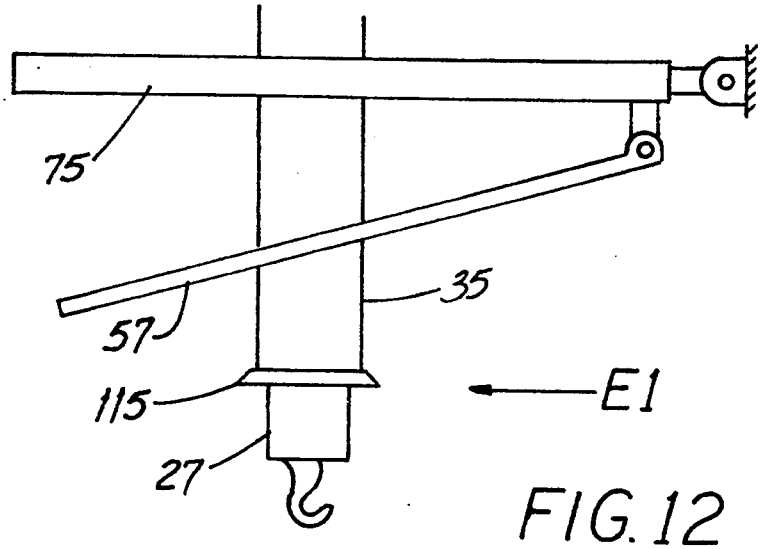
FIG. 12 is a simplified side elevation view showing a crane hoist bottom block and the inventive weight apparatus in a normal position. Parts are broken away.

In operation and referring to FIGS. 2, 5, 12, 13 and 14, it is assumed that the hoist drive 23 is in operation and that the bottom block 27 (and trip pan 115, if so equipped) are at a lower elevation (represented as E1) and are moving upward but, as shown in FIG. 12, are well spaced below the bar 57. Neither limit switch 49, 51 is tripped.

Figure 13:
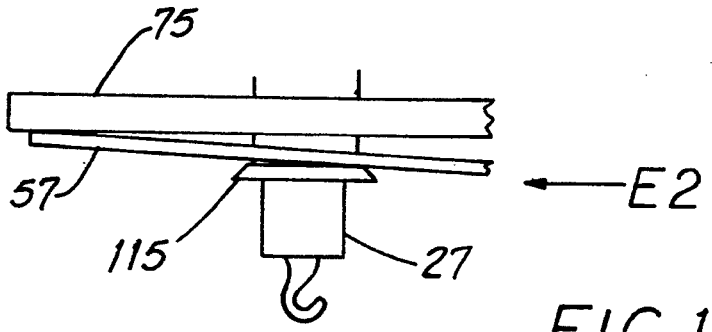
FIG. 13 is a simplified side elevation view like that of FIG. 12 and showing the inventive weight apparatus in a position which would normally trip the control circuit limit switch.

Referring to FIG. 13, it is now assumed that the operator has inadvertently overlooked the need to stop or slow movement of the block 27 in the upward direction. As a consequence, the block 27 attains an intermediate elevation (represented as E2) at which it contacts and sufficiently lifts the second bar 57 to trip the control circuit limit switch 47. Depending upon how the switch 47 is used in the control circuit, the drive 23 will either slow or stop. Bar spacing is selected so that even with inertial upward "drift" of the block 27, the first bar 75 will not be lifted.

Figure 14:
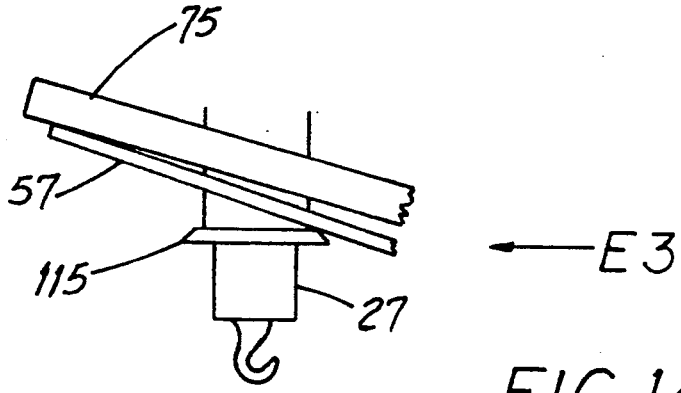
FIG. 14 is a simplified side elevation view like that of FIGS. 12 and 13 and showing the inventive weight apparatus in a position to trip the power circuit limit switch, assuming the control circuit limit switch did not trip for some reason.

Referring to FIG. 14, it is now assumed that for whatever reason, e.g., operator error or breakage of the limit switch 47 due to poor maintenance or the like, the block 27 continues its upward movement and attains a higher elevation represented as E3. In that instance, the surface 113 of the bar 57 contacts the bar 75 and the bar 75 is lifted by the bar 57. The bar 75 is lifted until the cable 77 starts to "go slack" and the counterweight 71 of the switch 49 starts to rotate the switch arm 65 as described above. If lifting of the bar 75 continues, the switch 49 opens and the source of electrical power and the motor power terminals are disconnected from one another. The drive 23 stops and further upward movement of the block 27 (with possible attendant breakage of cable 35 and load-dropping) is prevented.

While the principles of this invention have been described in connection with specific embodiments, it should be understood clearly that these descriptions are made only by way of example and are not intended to limit the scope of the invention.

What is claimed:

1. In a crane hoist system having a hoist drum, a drum drive motor, a motor control circuit limit switch and a motor power circuit limit switch, an improved limit switch weight apparatus comprising:

a first trip bar coupled to the power circuit limit switch;

a second trip bar coupled to the control circuit limit switch, and wherein;

the second trip bar is pivot-mounted for movement independently of the first trip bar;

the second trip bar and the first trip bar are suspended by separate cables; the second trip bar and the first trip bar move in sequence; and both limit switches operate to disable the drive motor in the hoisting direction.

2. The apparatus of claim 1 wherein the second trip bar:

has a first end; and pivots on a pivot joint adjacent to the first end.

3. The apparatus of claim 2 wherein the pivot joint is attached to the first trip bar.

4. The apparatus of claim 2 wherein:

the first trip bar has a first end attached to a swivel mount; and the pivot joint is attached to the first trip bar adjacent to the swivel mount.

5. The apparatus of claim 1 including a bottom block suspended from the hoist drum and movable between a lower elevation and an intermediate elevation and wherein:

the second trip bar has a large-area surface; and the surface is substantially in contact with the first trip bar when the bottom block is at the intermediate elevation.

6. The apparatus of claim 5 wherein the trip bars have differing cross-sectional shapes.

7. The apparatus of claim 1 wherein the second trip bar has a longitudinal axis and:

the second trip bar includes a support lug and a control lug; and the lugs extend laterally away from the axis.

8. The apparatus of claim 7 wherein:

the second trip bar has a second end;

the support lug is adjacent to the second end; and the control lug is spaced from the second end.

9. The apparatus of claim 1 wherein:

the power circuit limit switch has an arm rotatable between a motor-operating position and a motor-disabled position;

the hoist drum has a bottom block suspended therefrom;

the bottom block is contacting the second trip bar;

the second trip bar is contacting the first trip bar; and the power circuit limit switch arm is in the motor-disabled position.

10. In the combination of a crane and a crane hoist system, such system having a hoist drum, a drum drive motor, a motor control circuit limit switch and a motor power circuit limit switch, an improved limit switch weight apparatus comprising;

a first trip bar coupled to the power circuit limit switch;

a second trip bar coupled to the control circuit limit switch, such second trip bar having a first end, a second end and a longitudinal axis, such second trip bar including a support lug adjacent to the second end and a control lug spaced from the second end and both lugs extend laterally away from such axis; and wherein:

the second trip bar is pivot-mounted for movement independently of the first trip bar;

a support member extends between the support lug and a stationary point-on the crane;

a trip cable extends between the control lug and the control circuit limit switch; and the first trip bar is between the support member and the trip cable.

11. In a crane hoist system having a hoist drum, a drum drive motor, a motor control circuit limit switch and a motor power circuit limit switch, an improved limit switch weight apparatus comprising;

a first trip bar coupled to the power circuit limit switch;

a second trip bar coupled to the control circuit limit switch, and wherein the second trip bar:

is pivot-mounted for movement independently of the first trip bar;

has a first end and pivots on a pivot joint adjacent to such first end;

is curvilinear and has a second end which pivots on a second pivot joint adjacent to the second end.

12. The apparatus of claim 11 including a bottom block suspended from the hoist drum and movable between a lower elevation and an intermediate elevation and wherein:

the second trip bar has a surface extending between the first end and the second end; and the surface is substantially in contact with the first trip bar when the bottom block is at the intermediate elevation.

* * * * *